United States Patent [19]

Gulli

[11] 4,302,891

[45] Dec. 1, 1981

[54] JUMPING SHOE ATTACHMENT

[76] Inventor: Frank Gulli, 62 Livingston Ave., Dobbs Ferry, N.Y. 10522

[21] Appl. No.: 161,668

[22] Filed: Jun. 23, 1980

[51] Int. Cl.[3] ..... A43B 3/10

[52] U.S. Cl. ..... 36/7.8

[58] Field of Search ..... 36/7.8, 28

[56] References Cited

U.S. PATENT DOCUMENTS

| | | | |
|---|---|---|---|
| 898,084 | 9/1908 | Backermann | 36/7.8 |
| 3,205,596 | 9/1965 | Hoffmeister | 36/7.8 |
| 3,951,422 | 4/1976 | Hornsby | 36/7.8 |

*Primary Examiner*—Patrick D. Lawson
*Attorney, Agent, or Firm*—William L. Fisher

[57] ABSTRACT

Improvement in a jumping shoe attachment having a sole plate and an arrangement for attaching the sole plate to a user's shoe, the improvement comprising an arrangement including a ground operative hinge device disposed beneath the sole plate for yieldably holding the jumping shoe attachment against the user's weight in an elevated position above the ground, the hinge device comprising a pair of hinge plates hinged about a pair of stationary hinge axes affixed to the sole plate, the hinge axes being both centered and spaced apart lengthwise in respect to the sole plate, the lower ends of the hinge plates being operative against the ground, the hinge device including a plurality of tension springs for predetermining the amount of force by which a pair of the jumping shoe attachments overcomes the user's weight, the tension springs being connected to the inside walls of the hinge plates for yieldably pulling them together during use of the jumping shoe attachment, the tension springs being preselectable as to number and type to accommodate the user's weight, an elastomeric block affixed to the bottom of the sole plate between the hinge axes, and a pair of yieldable members for limiting the amount by which the hinge plates can be spread apart, the pair of yieldable members being disposed between the bottom of the sole plate and the outside walls of the hinge plates, respectively.

2 Claims, 5 Drawing Figures

JUMPING SHOE ATTACHMENT

My invention relates to jumping shoe attachments.

The principal object of my invention is the provision of an improved jumping shoe attachment, particularly for children which produces a good jumping action during walking or while standing in one location.

Figure 2:
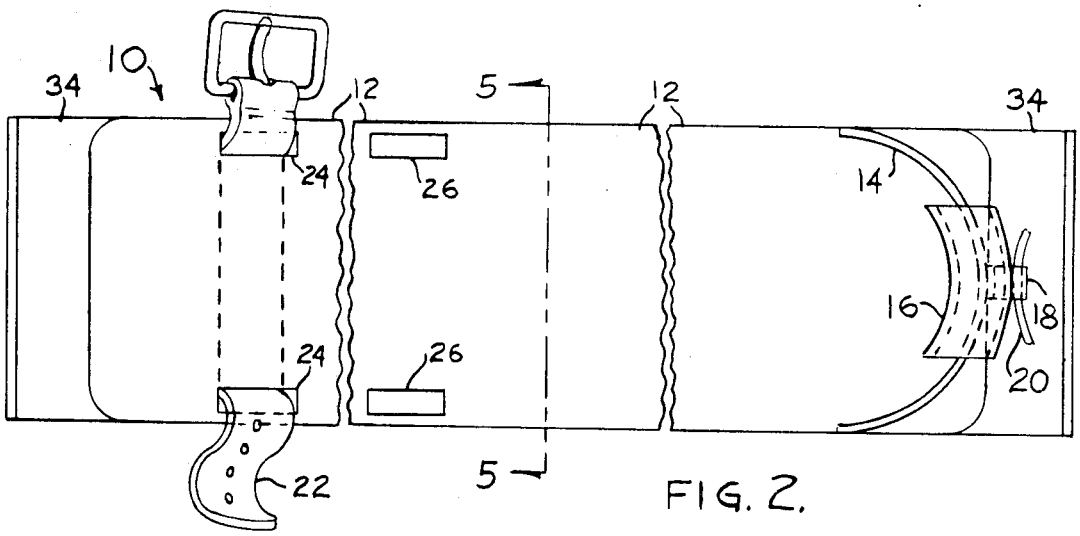
Figure 1:
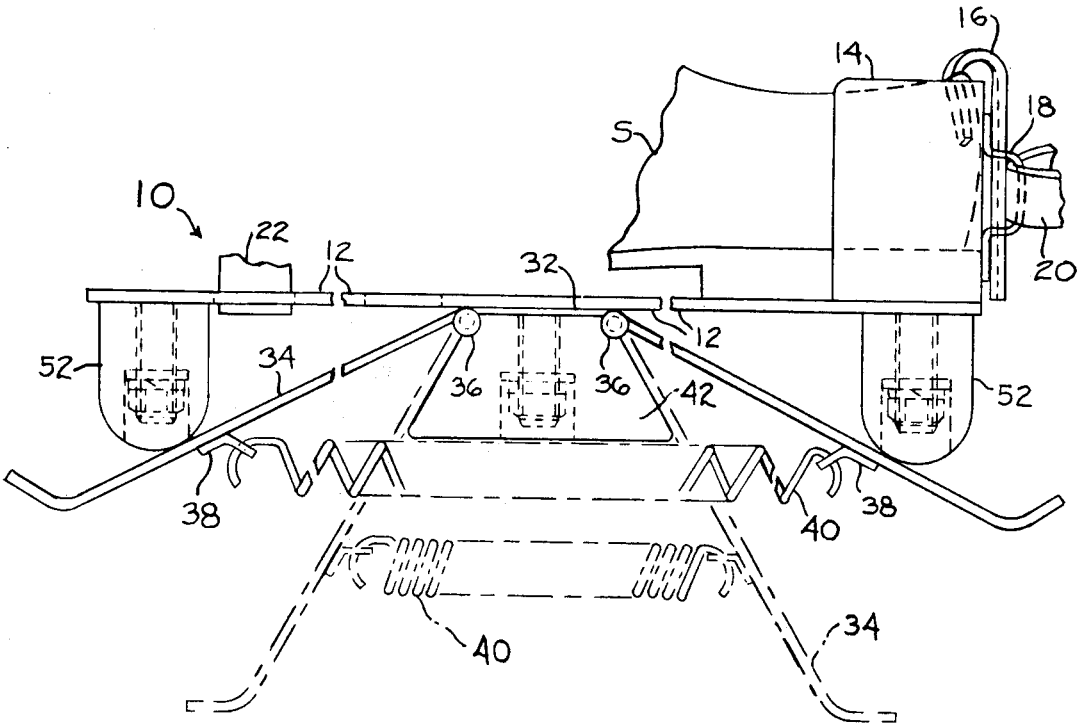
Figure 3:
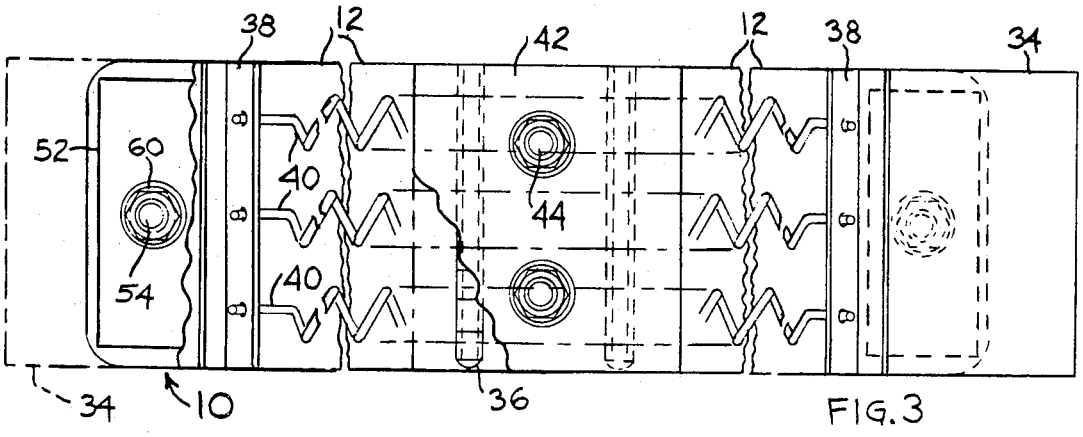
Figure 4:
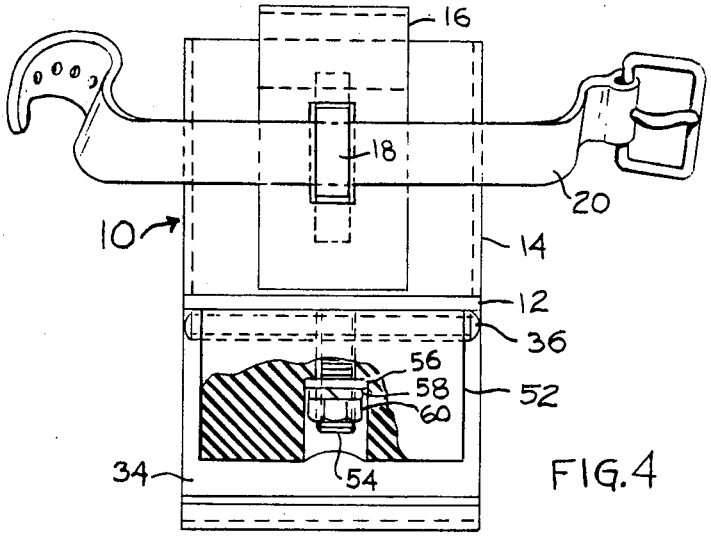
Figure 5:
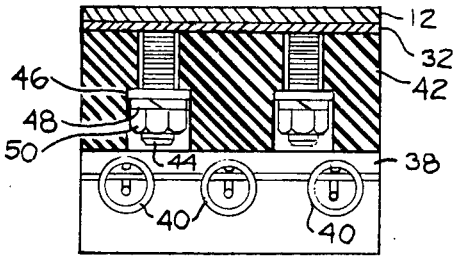

The foregoing object of my invention and the advantages thereof will become apparent during the course of the following description, taken in conjunction with the accompanying drawings, in which:

FIGS. 1–4 are, respectively, side elevational, top and bottom plan and rear end elevational views of a jumping shoe attachment embodying my invention; and FIG. 5 is a vertical sectional view of the structure of FIG. 2 taken on the line 5—5 thereof.

Referring to the drawings in greater detail, 10 generally designates said jumping shoe attachment which comprises a flat sole plate 12 and an arcuate heel plate 14 made fast to the top surface of said sole plate 12 and upstanding therefrom. A heel gripper 16 is held on said heel plate 14 via a bracket 18 made fast to the back surface thereof and forming an eye through which a heel strap 20 is made to pass. The heel gripper 16 has a generally U-shaped upper end thereon for gripping the heel of a user's shoe (designated "S" in FIG. 1) while conforming to the contour of the inside surface thereof. The sole plate 12 carries a toe strap 22 via pairs of apertures 24 and 26 for long and short shoes, respectively. Said jumping shoe attachment 10 further comprises a hinge device made fast to the underside of said sole plate 12 via a stationary center hinge plate 32. A pair of moveable hinge plates 34 having upturned outer ends are hingedly connected to said center plate 34 via hinge pins 36. The moveable plates 34 have angle iron members 38 made fast to the inside surfaces thereof which serve as anchors for opposite ends of a plurality of tension springs 40 which operate the moveable plates 34 to yieldably urge them inwardly toward each other and against the pull of gravity due to the user's weight, whereby to maintain the jumping shoe attachment 10 in its elevated position.

A rubber block 42 is fastened via a pair of counterbores therein and corresponding fasteners in said counterbores to the underside of said hinge plate 32 to serve as a limit to the inward movement of the plates 34. Each fastener consists of a stud 44 made fast to said plate 32, a washer 46, a lock washer 48 and a nut 50. The fore and aft surfaces of the block 42 conform to the relative angular position of the plates 34 in their pulled together position corresponding to the highest position of the jumping shoe attachment 10. The lowest position of the jumping shoe attachment 10 is determined by a pair of rubber blocks 52 which are made fast to the underside of the sole plate 12 at the front and rear ends thereof. Each block 52 is fastened to said sole plate 12 by a counterbore therein and a fastener in said counterbore consisting of a stud 54 made fast to said sole plate 12, a washer 56, a lock washer 58 and a nut 60. The pair of blocks 52 predetermines the maximum amount the plates 34 are allowed to spread apart against the action of the springs 40 by the jumping force created by the user.

In use of the jumping shoe attachment 10, the user first fastens the same to each of his shoes by the heel gripper 16 and straps 20 and 22. Thereupon the user can jump up and down on the jumping shoe attachment 10 while standing in one location or during walking. Within limits, the harder he jumps or the faster he walks the more he will bounce and the higher he will rise. Good and safe fun can be had by users of said jumping shoe attachment 10.

It will thus be seen that there has been provided by my invention a jumping shoe attachment in which the object hereinabove set forth, together with many throughly practical advantages, has been successfully achieved. For example, the amount of force by which a pair of jumping shoe attachments overcomes the user's weight can be predetermined by adjustment of the pulling force of the springs 40 upon the respective moveable plates 34 which is accomplished by preselecting the number and type of such springs 40. While a preferred embodiment of my invention has been shown and described, it is to be understood that variations and changes may be resorted to without departing from the spirit of my invention as defined by the appended claims.

What I claim is:

1. Improvement in a jumping shoe attachment having a sole plate and means for attaching said sole plate to a user's shoe, said improvement comprising means including a ground operative hinge device disposed beneath said sole plate for yieldably holding the jumping shoe attachment against the user's weight in an elevated position above the ground, said hinge device comprising a pair of hinge plates hinged about a pair of stationary hinge axes affixed to said sole plate, said hinge axes being both centered and spaced apart lengthwise in respect to said sole plate, the lower ends of said hinge plates being operative against the ground, said hinge device including a plurality of tension springs for predetermining the amount of force by which a pair of said jumping shoe attachments overcomes the user's weight, said tension springs being connected to the inside walls of said hinge plates for yieldably pulling them together during use of said jumping shoe attachment, said tension springs being preselectable as to number and type to accommodate the user's weight, means in the form of an elastomeric block affixed to the bottom of said sole plate between said hinge axes for limiting the amount by which said hinge plates can be pulled together, and means in the form of a pair of yieldable members for limiting the amount by which said hinge plates can be spread apart, said pair of yieldable members being disposed between the bottom of said sole plate and the outside walls of said hinge plates, respectively.

2. Improvement as claimed in claim 1, said jumping shoe attachment including a heel plate and a heel gripper held on said heel plate for gripping the heel of a user's shoe.

* * * * *